United States Patent [19]

Livingston

[11] 4,415,093

[45] Nov. 15, 1983

[54] GARMENT HANGER SPACING APPARATUS

[76] Inventor: Lucy J. Livingston, 9803 Colony Place, Kansas City, Mo. 66131

[21] Appl. No.: 288,471

[22] Filed: Jul. 30, 1981

[51] Int. Cl.[3] ..... A47J 51/142

[52] U.S. Cl. ..... 211/113; 223/85; 24/16 PB; 16/87.2

[58] Field of Search ..... 211/113, 118, 119, 123; 248/DIG. 9, 61, 60; 24/256, 257, 16 PB; 206/820; 223/85

[56] References Cited

U.S. PATENT DOCUMENTS

| | | | |
|---|---|---|---|
| 236,487 | 1/1881 | Day | 16/87.2 |
| 2,320,308 | 5/1943 | Silverman | 16/87.2 |
| 2,604,999 | 7/1952 | Sutton | 211/113 |
| 2,868,389 | 1/1959 | Friend | 211/123 |
| 2,895,618 | 7/1959 | Ivan | 211/123 |
| 2,932,407 | 4/1960 | Citon | 211/113 |
| 3,313,424 | 4/1967 | Gingher | 211/113 |
| 3,482,746 | 12/1969 | Ferguson | 223/85 |
| 3,506,116 | 4/1970 | Winters | 206/820 X |
| 3,515,319 | 6/1970 | Furtak et al. | 223/85 |
| 3,527,358 | 9/1970 | Wheeler | 223/85 |
| 3,528,590 | 9/1970 | Nathanson | 223/85 |
| 3,633,801 | 1/1972 | Bonasso | 223/85 X |
| 3,757,936 | 9/1973 | Lindgren | 24/16 PB X |
| 3,792,804 | 2/1974 | Ponzo | 211/113 X |
| 4,010,503 | 3/1977 | Denfon | 16/87.2 |

*Primary Examiner*—William E. Lyddane
*Assistant Examiner*—Peter A. Aschenbrenner
*Attorney, Agent, or Firm*—Litman, Day & McMahon

[57] ABSTRACT

An apparatus for spacing garment hangers having suspension hooks on a garment-supporting rod, comprising a flexible strap member having a middle portion, a first end portion with an aperture therethrough, and a second end portion. Clasp means is provided for connecting the strap member end portions together in mutually opposed, downwardly-depending relationship from the garment-supporting rod with the strap member middle portion at least partially encircling the rod. The aperture through the strap member first end portion is adapted for removably receiving a respective garment hanger suspension hook.

5 Claims, 5 Drawing Figures

Fig. 1.
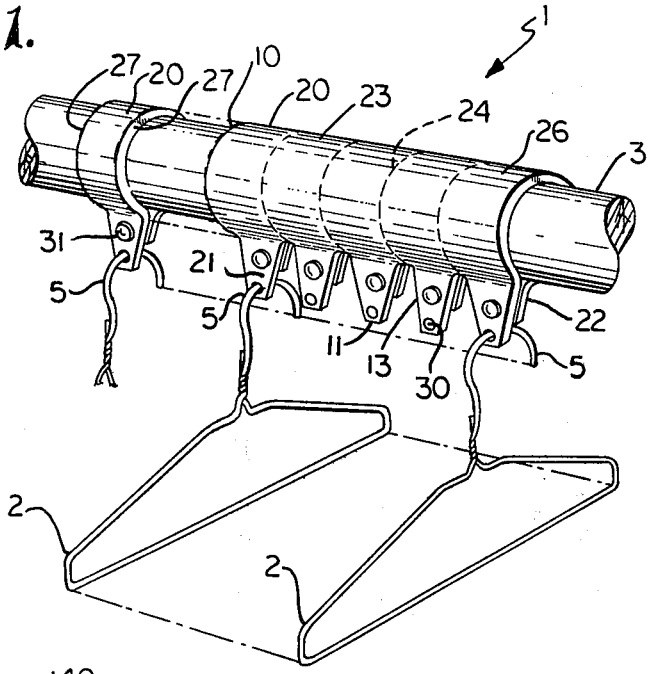
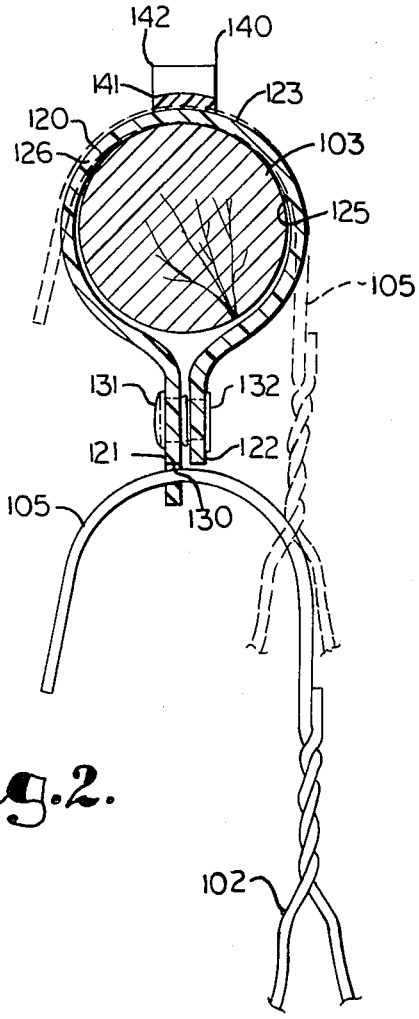
Fig. 2.
Fig. 5.
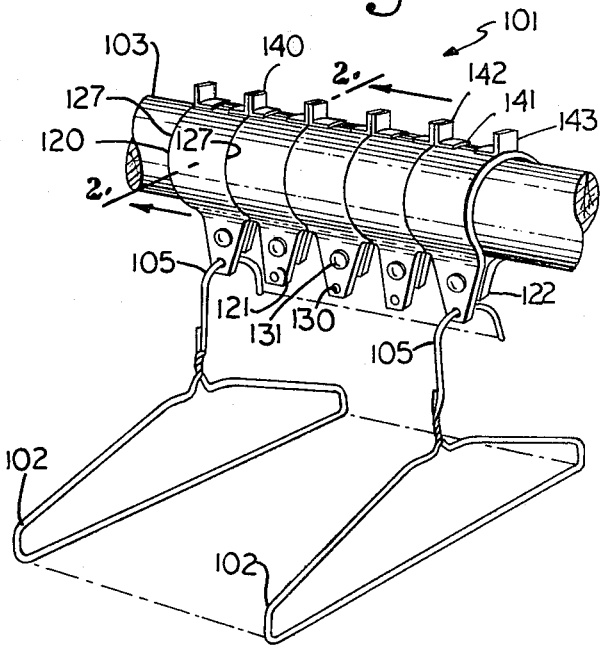

GARMENT HANGER SPACING APPARATUS

BACKGROUND OF THE INVENTION

1. Field of the Invention

This invention relates to garment hangers, and in particular, to an apparatus for spacing garment hangers having suspension hooks on a garment-supporting rod.

2. Description of the Prior Art

Devices for spacing garment hangers are well known and a variety of designs have been developed for maintaining a predetermined spacing between garments suspended from garment-supporting rods and the like. One type of garment hanger supporting device is illustrated in the Sutton U.S. Pat. No. 2,604,999 and comprises a U-shaped bracket with legs extending downwardly therefrom for placing on a clothesline. The longer of the legs has a plurality of spaced apertures therethrough for receiving the hooks of clothes-hangers. However, such a device is primarily for use with a substantially straight clothesline and is not readily adjustable to different lengths. Also, no provision is made for subdividing the bracket into individual units to be placed between respective pairs of clothes-hangers. The Ivan U.S. Pat. No. 2,920,776 also shows a device for use with garment hangers having a plurality of spaced apertures for receiving the hooks of respective garment hangers. However, this device is also not readily adjustable to different lengths or separable into individual spacers or retainers. Further, the retainer disclosed in the Ivan patent is primarily for use with straight garment-supporting rods as opposed to circular rods.

A different type of apparatus for use with garment hangers, as exemplified in the Wheeler U.S. Pat. No. 3,527,358, comprises an attachment for the hook portion of an individual garment hanger. The garment hanger hooks are then placed over a garment-supporting rod in a conventional fashion with the attachments thereon. However, the individual attachments as shown therein are not interconnected for maintaining a predetermined spacing between adjacent garment hangers. Also, the garment hanger attachments according to the Wheeler patent are not designed to be fixedly attached to the garment-supporting rod and are thus subject to being lost or misplaced.

Prior art devices for use with garment hangers tended to be either adapted primarily for attachment to individual garment hangers and removable therewith, or of a predetermined length and adapted for attachment to straight garment-supporting rods.

SUMMARY OF THE INVENTION

In the practice of the present invention, an apparatus for spacing garment hangers having suspension hooks on a garment-supporting rod is provided which is adapted for use either as a continuous strip of juxtaposed strap members for attachment to a straight garment-supporting rod or as a plurality of individual strap members removably attached to a garment-supporting rod having either a straight or curvilinear configuration. The individual strap members are adapted for receiving the hooks of garment hangers either attached thereto or placed therebetween over the rod. Each strap member includes a first end portion with an aperture therethrough for receiving the hook of a garment hanger and a second end portion. Clasp members are positioned on the end portions and are mutually attachable for connecting the end portions together in mutually opposed, downwardly-depending relationship from the garment-supporting rod with a strap member middle portion at least partially encircling the rod.

The juxtaposed, connected strap members comprise a continuous, elongated strip of flexible material with outer margins. Each of the outer margins has a plurality of longitudinally spaced notches extending inwardly therefrom. The strip is divided by a plurality of transverse tear lines each extending across the strip between a respective opposed pair of the notches.

The spacing apparatus of the present invention is particularly adaptable for attaching and spacing conventional hangers to garment-supporting rods of different lengths and configurations. Versatility in use is achieved because the strap members may be positioned together in continuous, juxtaposed relationship for suspending garment hangers below the garment-supporting rod in a predetermined spaced relationship, or the continuous strip may be subdivided at a transverse tear line to achieve an appropriate length for a given clothes-supporting rod. Alternatively, the strip may be separated at its tear lines into individual strap members which may then be attached to a clothes rod, including one with a curvilinear configuration. Garment hangers are placed therebetween over the garment-supporting rod or their suspension hooks are removably inserted in respective apertures through end portions of the strap members.

A modified embodiment of the present invention includes spacer members attached to the individual strap members to prevent entanglement therebetween. The spacer members also maintain garment hanger suspension hooks positioned between adjacent strap members.

The continuous strip and the individual strap members are readily removable from the garment-supporting rod by detaching clasp members positioned on the strap member end portions. Simplicity in manufacturing is achieved since the continuous strip may be stamped or cut from a flat sheet of flexible material in any predetermined length on, for example, a rotary die-cutting machine.

The principle objects of the present invention are: to provide an apparatus for spacing garment hangers on a garment-supporting rod; to provide such a spacing apparatus which is adapted for use with garment-supporting rods having different lengths and either straight or curvilinear configurations; to provide such a spacing apparatus which comprises a strap member with a middle portion and opposite end portions; to provide such a spacing apparatus which includes clasp means for attaching the end portions together in mutually opposed, downwardly-depending relationship from the garment-supporting rod; to provide such a spacing apparatus with an aperture through a first end portion for receiving the suspension hook of a garment hanger; to provide such a spacing apparatus which comprises a continuous strip of juxtaposed strap members demarcated and separable at transverse tear lines; to provide such a spacing apparatus which may be used as either a continuous strip of juxtaposed strap members or as individual, spaced strap members; to provide such a spacing apparatus wherein garment hanger suspension hooks may be suspended from or placed between strap members; to provide such a spacing apparatus which remains attached to a garment-supporting rod when a respective garment hanger is removed therefrom; to provide such a spacing apparatus which includes a spacer attached to each strap member for preventing entanglement between adjacent strap members and garment hangers, and to provide such a spacing apparatus which is economical to manufacture, efficient in use, capable of a long operating life and particularly well adapted for the proposed use.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a garment hanger spacing apparatus embodying the present invention and attached to a garment-supporting rod with garment hangers suspended therefrom.

FIG. 2 is an enlarged, vertical cross-sectional view of the spacing apparatus taken generally along line 2—2 in FIG. 1.

FIG. 5 is a perspective view of a garment hanger spacing apparatus comprising a modified embodiment of the present invention with a plurality of strap members having spacer members attached thereto.

DESCRIPTION OF THE PREFERRED EMBODIMENTS

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 4:
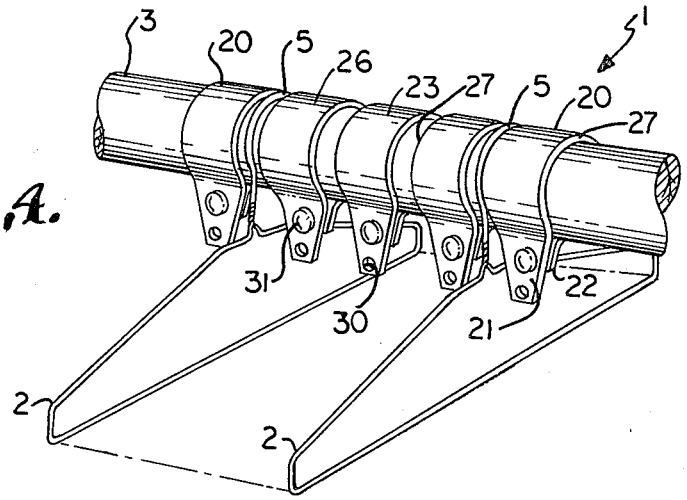
FIG. 4 is a perspective view of the spacing apparatus with the individual strap members separated and having garment hangers positioned therebetween with their suspension hooks over the garment-supporting rod.

For purposes of description herein, the terms "upper", "lower", "vertical", "horizontal", and derivatives thereof shall relate to the invention as oriented in FIG. 1 for the primary embodiment and as oriented in FIG. 4 for the modified embodiment. However, it is to be understood that the invention may assume various alternative orientations, except where expressly specified to the contrary.

Referring to the drawings in more detail, the reference numeral 1 generally designates an apparatus for spacing garment hangers 2 on a horizontally extending garment-supporting rod 3. The garment hangers 2 as shown are of a common type constructed of bent wire and each includes an arcuate suspension hook 5. The arcuate configuration of the hanger suspension hook 5 corresponds to the circular cross-section configuration of the garment-supporting rod 3. The arcuate configuration of the suspension hook 5 comprises a portion of a circle having a slightly greater diameter than a circle defining the cross-sectional configuration of the rod 3 so that the hook 5 is slidable with respect to the rod 3 when placed thereover.

Figure 3:
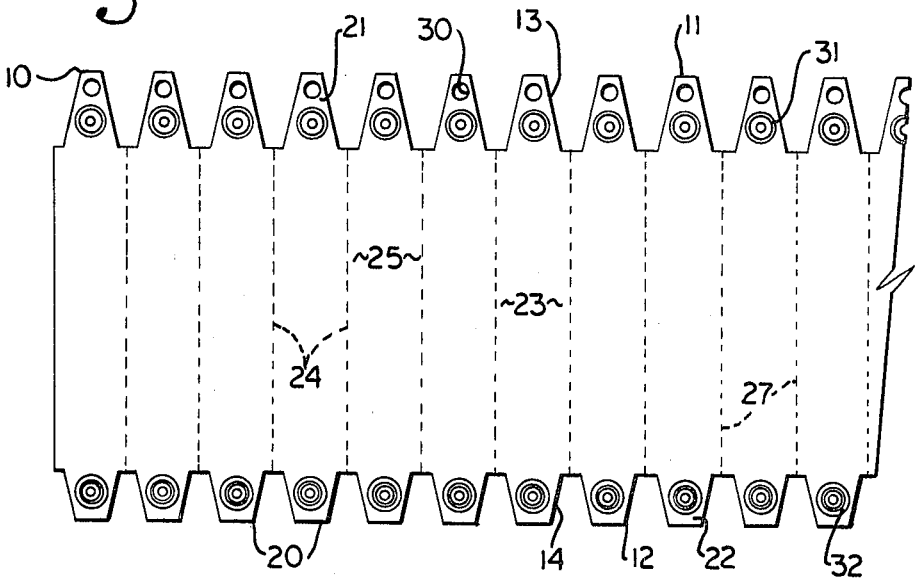
FIG. 3 is a fragmentary top plan view of a continuous strip of the strap members, particularly showing a plurality of transverse tear lines and first and second clasp members.

The spacing apparatus 2 comprises a continuous strip 10 of a resilient, flexible material such as plastic. As shown in FIG. 3, the strip 10 may be produced from a substantially planar flat sheet of such material and has a first and a second outer margin 11 and 12 respectively. A plurality of longitudinally spaced first notches 13 extend inwardly from the strip first outer margin 11 and a plurality of notches 14 extend inwardly from the second outer margin 12 and correspond to respective opposite first notches 13.

The strip 10 comprises a plurality of juxtaposed transverse strap members 20 each having a first end portion 21 at the first outer margin 11 and a second end portion 22 at the second outer margin 12. Each strap member first end portion 21 is adjacent at least one respective first notch 13 and each strap member second end portion 22 is adjacent at least one respective second notch 14. Each strap member 20 includes a middle portion 23 positioned between its first and second end portions 21 and 22 respectively. Each strap member 20 includes a pair of opposite side edges 27. The strap members 20 are demarcated by and separable at a plurality of transverse tear lines 24 each colinear with a respective pair of side edges 27 and extending transversely across the strip 10 between a pair of opposite first and second notches 13 and 14 respectively. Each strap member first end portion 21 includes an aperture 30 therethrough having a slightly greater diameter than the thickness of the suspension hook 5. A first clasp member 31 is positioned between the aperture 30 and the strap member middle portion 23. Each strap member second end portion 22 has a second clasp member 32 attached thereto and adapted for being attachably connected to a respective first clasp member 21.

The strap members 20 are attached to the garment-supporting rod 5 by placing their respective middle portions 23 against the garment-supporting rod 3 and squeezing together their respective end portions 21 and 22 so that the strap member middle portion 23 at least partially encircles the rod 3. The clasp member 31 and 32 are detachably snapped together whereby the opposite end portions 21 and 22 are connected together in mutually opposing, downwardly depending relationship by their first and second clasp members 31 and 32 respectively. With the strap member end portions 21 and 22 thus connected, the strap member second end portion 22 terminates in spaced relation above the aperture 30. The aperture 3 is thus adapted to receive a garment hanger suspension hook 5 therethrough whereby a respective garment hanger 2 may be suspended from each strap member 20 in spaced relation below the garment-supporting rod 5. The spacing apparatus 1 may be used as a continuous strip 10 of the strap members 20 and the strip 10 may be subdivided at any transverse tear line 24 to a desired length to accomodate a particular garment-supporting rod. Thus, the continuous strip 10 of juxtaposed strap members 20 is readily adaptable to extend substantially the entire length of any garment-supporting rod 3. Also, the continuous strip 10 is separable at any transverse tear line 24 to accomodate, for example, a rod-supporting bracket (not shown) placed at an intermediate position along the length of a respective garment-supporting rod 3 to prevent sagging thereof. As shown in FIG. 1, each strap member 2 of the continuous strip 10 is adapted for supporting a respective garment hanger 2 having its suspension hook 5 extended through the first end portion aperture 30. The garment hangers 2 are thus maintained in spaced relationship depending downwardly below and supported by the rod 3. The predetermined spacing of the garment hangers thus achieved by the spacing apparatus 1 of the present invention functions to prevent entanglement therebetween and also facilitate the removal of garments placed on the hangers, because the hangers are prevented for becoming tightly bunched together whereby little or no space is provided between garments to facilitate their removal or insertion in closets, clothes racks and the like.

Alternatively, the strip 10 may be subdivided along its transverse tear lines 24 into a plurality of separate individual strap members 20 as shown in FIG. 4. The individual strap members 20 may then be utilized for maintaining garment hangers 2 in a predetermined spaced relationship by either placing their suspension hooks 5 in respective apertures 30 or by placing the suspension hooks 5 over the rod 3 between adjacent strap member side edges 27 (FIG. 3). The cross-sectional configuration of the strap members 20 preferably has a greater maximum width than the maximum width across the open part of the garment hanger suspension hooks 5 whereby the garment hanger suspension hooks 5 are too narrow to be placed over the strap members 20. Thus, when the garment hangers 2 are placed on the rod 3 in the manner shown in FIG. 3, they must be placed between the respective side edges 27 of adjacent strap member 20, thereby positioning the garment hangers 2 in a predetermined spacing along the rod 3.

Garment-supporting rods (not shown) having curvilinear or circular configurations are frequently encountered in retail clothing outlets whereat articles of clothing are displayed thereon. To accomodate such curvilinear rods, the strip 10 is separated into separate, individual strap members 20 which are attached to the rod and follow its curvature. Garment hangers 2 may be supported by the curvilinear rod by placing their suspension hooks 5 either in apertures 30 or over the rod between respective pairs of strap member side edges 27 in the appropriate manner described herein.

The end portions 21 and 22 of the strap members 20 are detachably connected by the clasp members 31 and 32 when the strap members 20 are in their closed positions secured to the rod 3. The strap members 20 are easily removable from the rod 3 by spreading their end portions 21 and 22 outwardly with respect to each other and thus disengaging the clasp members 31 and 32. However, the spacing apparatus 1, whether attached to the rod 3 as a continuous strip 10 or as individual strap members 20, is adapted to remain thereon when the garment hangers 2 are removed. Therefore, because the strip 10 or strap members 20 substantially encircle the rod 3 in their respective closed positions as shown in FIGS. 1 and 3, accidental loss or misplacement is prevented. If desired, the clasp means for securing the end portions 21 and 22 together may comprise a more permanent type of fastener. Without limitation on the generality of useful fastening means, the end portions 21 and 22 may be connected together by, for example, an adhesive, screws, rivets, or nuts and bolts.

The strap member first end portion 121 has an aperture 130 extending therethrough and having a diameter slightly greater than the thickness of the garment hanger suspension hook 105. A first clasp member 131 extends through the strap member first end portion 121 in spaced relation between the aperture 130 and the strap member middle portion 123. A second clasp member (not shown) is positioned on each strap member second end portion and aligned with a respective first clasp member 131 for removable attachment thereto when the end portions 121 and 122 are positioned in mutually opposed, downwardly-depending relationship from the rod 103. With the strap members 120 in their closed positions as shown in FIG. 5, the strap member middle portions 123 substantially encircle the rod 103.

A pair of spacer members 140 are attached to the middle portion 123 of each strap member 120. Each spacer member 140 includes a horizontal base portion 141 attached to a respective strap member 120 and an upright portion 142 integrally connected to the base portion 141 and extending upwardly therefrom at a substantially right angle with respect to the base portion 141. Each upright portion 142 includes a vertical face 143 positioned flush with a respective strap member opposite side edge 127 and extending upwardly therefrom. The spacer members 140 are adapted to prevent adjacent strap members 120 from overlapping each other whereby garments and garment hangers 102 suspended therebelow could become entangled or closely packed.

The spacer members 140 are particularly useful with the spacing apparatus 101 when the garment supporting rod 103 has a substantially smaller diameter than that of the strap member middle portions in their closed positions, whereby a substantial gap is created between the strap members 120 and the garment-supporting rod 103. In such an application, the vertical faces 143 of adjacent spacer members 140 abut and the spacer members 140 prevent adjacent strap members 120 from overlapping each other. The strap member opposite side edges 127 are thus maintained in abutting relationship with the garment hangers 102 suspended by their hooks 105 in respective apertures 130 in a predetermined spacing. Alternatively, as shown in FIG. 5, the spacer members 140 may be employed to prevent the suspension hooks 105 placed over the rod 103 from being inadvertently pushed up onto adjacent strap member middle portions 123. The suspension hooks 105 are thus maintained in a predetermined spacing between respective pairs of adjacent spacer member vertical faces 143 and strap member side edges 127.

It is to be understood that while I have illustrated and described certain forms of my invention, it is not to be limited to the specific forms or arrangement of parts herein described and shown.

What is claimed and desired to secure by Letters Patent is:

1. An apparatus for spacing garment hangers having suspension hooks on a garment-supporting rod, which comprises:

(a) a continuous elongated strip of flexible material having a first and a second outer margin positioned opposite with respect to each other, each of said outer margins having a plurality of longitudinally evenly spaced notches extending inwardly therefrom;

(b) a transverse tear line extending across said strip between a respective corresponding opposite pair of said notches;

(c) said strip comprising a plurality of juxtaposed, transverse strap members, each of said strap members having:

(1) a middle portion;

(2) a first end portion positioned adjacent said first outer margin and having a hook-receiving aperture therethrough for receiving a respective garment hanger suspension hook and a first clasp member aperture therethrough positioned inwardly of said hook-receiving aperture; and (3) a second end portion positioned adjacent said second outer margin and having a second clasp member aperture therethrough;

(d) a plurality of first clasp members each positioned in a respective first clasp member aperture; and (e) a plurality of second clasp members each positioned in a respective second clasp member aperture;

(f) said strip having an open flat position with a substantially planar configuration and a closed position with said strap middle portions substantially encircling said garment-supporting rod, said clasp member apertures aligned and each said second clasp member being attached to a respective first clasp member whereby respective strap member first and second end portions are connected in mutually opposed, downwardly-depending relationship from said garment-supporting rod.

2. The spacing apparatus as set forth in claim 1 which includes:

(a) a pair of spacer members attached to each said strap middle portion, each of said spacer members comprising:

(1) a horizontal base member positioned on said strap member middle portion and attached thereto and an upright member integrally connected to said base member and extending therefrom in a direction substantially normal to said strap member middle portion, said upright member having a vertical face.

3. An apparatus for spacing garment hangers having suspension hooks on a garment-supporting rod, which comprises:

(a) a continuous elongated strip of flexible material having first and second outer margins positioned opposite with respect to each other, each of said outer margins having a plurality of longitudinally evenly spaced notches extending inwardly therefrom;

(b) said strip comprising a plurality of juxtaposed, transverse strap members separable with respect to each other by transversely cutting said strip between respective opposite corresponding pairs of said notches, each of said strap members having:

(1) a middle portion;

(2) a first end portion positioned at said first outer margin, said first end portion having a hook-receiving aperture therethrough for receiving a respective garment hanger suspension hook and a first clasp member aperture therethrough positioned inwardly of said hook-receiving aperture; and (3) a second end portion positioned adjacent said second outer margin and having a second clasp member aperture therethrough; and (c) a plurality of mechanical fasteners for detachably securing respective corresponding opposite strap member end portions together, each said mechanical fastener including:

(1) a first clasp member positioned in a respective first clasp member aperture; and (2) a second clasp member positioned in a respective second clasp member aperture;

(d) said strip having an open flat position with a substantially planar configuration and a closed position with said strap middle portions substantially encircling said garment-supporting rod, said clasp member apertures aligned and each said second clasp member being attached to a respective first clasp member whereby said respective strap member first and second end portions are detachably connected in mutually opposed, downwardly-depending relationship from said garment-supporting rod.

4. The spacing apparatus as set forth in claim 3 which includes:

(a) a transverse tear line extending across said strip between a respective opposite corresponding pair of said notches, said strip being separable along said tear line.

5. The spacing apparatus as set forth in claim 3 wherein:

(a) said strip in its closed position is longitudinally bendable to accommodate a curvilinear garment-supporting rod without separating said strap members.

* * * * *